US009157179B2

(12) United States Patent
Hartoka et al.

(10) Patent No.: US 9,157,179 B2
(45) Date of Patent: Oct. 13, 2015

(54) LAUNDRY DRYER THE DRYING EFFECTIVENESS OF WHICH IS INCREASED BY USING DIFFERENT HEAT SOURCES

(75) Inventors: Onur Hartoka, Istanbul (TR); Yavuz Sahin, Istanbul (TR); Erdem An, Istanbul (TR); Mehmet Kaya, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 414 days.

(21) Appl. No.: 13/380,939

(22) PCT Filed: Jun. 16, 2010

(86) PCT No.: PCT/EP2010/058499

§ 371 (c)(1),
(2), (4) Date: Mar. 16, 2012

(87) PCT Pub. No.: WO2011/000704

PCT Pub. Date: Jan. 6, 2011

(65) Prior Publication Data

US 2012/0167404 A1 Jul. 5, 2012

(30) Foreign Application Priority Data

Jun. 29, 2009 (TR) ..... A 2009 05037

(51) Int. Cl.
*D06F 58/20* (2006.01)

(52) U.S. Cl.
CPC ..... *D06F 58/206* (2013.01)

(58) Field of Classification Search
CPC ..... D06F 58/00; D06F 58/06; D06F 58/20; F26B 21/00; F26B 21/06; G01M 1/00; G01M 1/16; G01R 21/00
USPC ..... 34/381, 411, 413; 68/5 C, 5 R; 8/132, 8/149, 159; 73/460, 65.07, 65.01; 702/60
See application file for complete search history.

(56) References Cited

U.S. PATENT DOCUMENTS 7,526,879 B2 * 5/2009 Bae et al. ..... 34/596
8,042,282 B2 * 10/2011 Oh et al. ..... 34/595

(Continued)

FOREIGN PATENT DOCUMENTS

DE 20101641 U1 6/2002
DE 102004055926 A1 5/2006

(Continued)

OTHER PUBLICATIONS

Peltier background. Encyclopedia Brittanica online printed Dec. 10, 2013.*

(Continued)

*Primary Examiner* — Stephen M Gravini
(74) *Attorney, Agent, or Firm* — Venjuris, P.C.

(57) ABSTRACT

The laundry dryer (1) of the present invention comprises a drum (2) wherein the laundry desired to be dried is placed, a channel (5) having an inlet allowing the cycle air to enter into the drum (2) and an outlet allowing the cycle air to leave the drum (2), providing the cycle air to be circulated in a closed cycle, a condenser (4) that provides the cycle air leaving the drum (2) to be dehumidified by being condensed, a heater (3) that provides the dehumidified cycle air leaving the condenser (4) to be heated and at least one fan (6) that maintains the cycle air to move along the length of the channel (5).

12 Claims, 1 Drawing Sheet

(56) References Cited

U.S. PATENT DOCUMENTS

Figure 1:
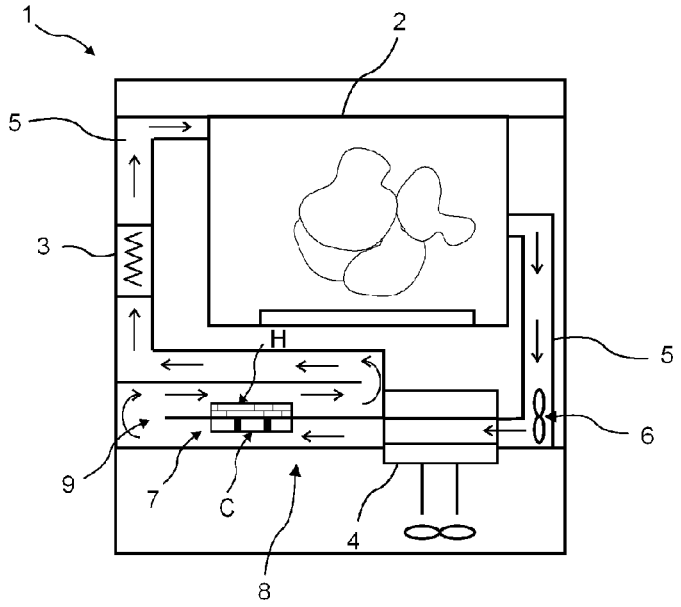

| | | | | |
|---|---|---|---|---|
| 8,240,064 | B2 * | 8/2012 | Steffens | 34/480 |
| 8,375,599 | B2 * | 2/2013 | Dey et al. | 34/595 |
| 2005/0155393 | A1 * | 7/2005 | Wright et al. | 68/3 R |
| 2007/0101602 | A1 * | 5/2007 | Bae et al. | 34/77 |
| 2009/0293301 | A1 * | 12/2009 | Koch et al. | 34/467 |
| 2010/0083524 | A1 * | 4/2010 | Muller et al. | 34/443 |
| 2010/0146809 | A1 * | 6/2010 | Grunert et al. | 34/443 |
| 2010/0146811 | A1 * | 6/2010 | Steffens | 34/480 |
| 2011/0030238 | A1 * | 2/2011 | Nawrot et al. | 34/499 |
| 2011/0030239 | A1 * | 2/2011 | Dey et al. | 34/524 |
| 2011/0041355 | A1 * | 2/2011 | Kuhl et al. | 34/282 |
| 2011/0047813 | A1 * | 3/2011 | Kuhl et al. | 34/468 |
| 2012/0017456 | A1 * | 1/2012 | Grunert | 34/82 |
| 2012/0167404 | A1 * | 7/2012 | Hartoka et al. | 34/76 |
| 2013/0192085 | A1 * | 8/2013 | Moschutz et al. | 34/491 |

FOREIGN PATENT DOCUMENTS

| | | | | |
|---|---|---|---|---|
| DE | 102006003816 | A1 | 8/2007 | |
| DE | 102006005810 | A1 | 8/2007 | |
| DE | 102006026251 | A1 | 12/2007 | |
| DE | 102006042991 | A1 | 3/2008 | |
| JP | 08057194 | A * | 3/1996 | D06F 58/00 |

OTHER PUBLICATIONS

NPL Peltier effect titled Thermoelectric effect downloaded from internet on Apr. 3, 2014.*

NPL google search for "peltier element" downloaded from internet on Apr. 3, 2014.*

* cited by examiner

LAUNDRY DRYER THE DRYING EFFECTIVENESS OF WHICH IS INCREASED BY USING DIFFERENT HEAT SOURCES

The present invention relates to a hybrid type laundry dryer the drying effectiveness of which is increased by using different heat sources.

In laundry dryers having a closed cycle, the drying air, after performing the moisture absorption process from the laundry, is cooled by being passed through a cooling system and the water vapor contained therein is provided to be condensed. After the cooling process, the drying air is passed over a heater and delivered to the drum again thereby providing to evaporate the water remaining on the laundry. The laundries are dried at the end of this process repeated in a closed cycle and the drying process is completed. In air or water cooled systems, the drying air is cooled with the surrounding air by being passed through the cross flow condenser and thus, the condensation process is provided to be realized. The use of Peltier elements that function according to the thermoelectric effect principle in order to increase the drying effectiveness is known in the prior art documents. Several of these are explained below.

In the state of the art German Patent Application No DE102006003816, the drying air leaving the drum is first cooled on the cold surfaces of the Peltier module and afterwards heated on the other surface of the Peltier module.

Another state of the art document is the Patent Application No DE102006005810. In this application, improvement of sealing is explained in the heat exchanger having a Peltier element disposed thereon.

In the state of the art German Utility Model Application no DE20101641, the drying air leaving the drum enters the condenser after passing through the cold surface of the Peltier element and the air leaving the condenser is delivered this time into the drum after passing through the hot surface of the Peltier element and the heater.

In this patent document, the condenser is situated between the hot surface and the cold surface of the Peltier element in the direction of air flow. In other words, the drying air passing through the cold surface of the Peltier element reaches the hot surface of the Peltier element after passing through the condenser. In this case, consuming more energy on the Peltier element or increasing the fin performance on the cold surface is required in order to perform an effective drying at the outlet of the condenser. In order to increase the fin performance, modifications are made in the number and geometry of the fin. However, the modifications to be made on the fins result in costs and lowering of pressure in the channel through which the drying air passes.

The aim of the present invention is the realization of laundry dryer the drying effectiveness of which is increased.

In the laundry dryer realized in order to attain the aim of the present invention, explicated in the first claim and the respective claims thereof, the dehumidifying process of the cycle air is performed in two stages, first by passing through the condenser then the cold surface of the Peltier element and the heating process of the cycles air is performed in two stages first by passing through the hot surface of the Peltier element thereafter over the heater.

The Peltier element is disposed between the condenser and heater such that the cold surface is positioned after the condenser and the hot surface before the heater according to the flow direction of the cycle air. The cycle air, since first cooled by the condenser, can reach the dew point (the temperature at which condensation starts on the cold surface contacted by the cycle air) more easily upon reaching the cold surface of the Peltier element. Therefore, the heat transfer (convection) coefficient is higher and it is easier to reach the predetermined thermal resistance value by causing to increase the performance of the cold surface. As a result of the cycle air reaching the cold surface of the Peltier element at a value close to the dew point, the performance (COP) value of the Peltier element is increased by increasing the cold surface temperature of the Peltier element and lowering the temperature difference between the cold and hot surfaces of the Peltier element.

In an embodiment of the present invention, one end of the connection channel is fastened to the portion of the channel wherein the condenser outlet is situated and the other end to the portion of the channel wherein the heater is situated. The connection channel comprises at least one bend, preferably in a "U" or "C" form, which provides the cycle air leaving the condenser to pass over the hot surface by turning 180°, after passing over the cold surface. In this embodiment of the present invention, the connection channel is in a horizontal position such that the cycle air is allowed to move in the horizontal direction.

In another embodiment of the present invention, the fan that provides the circulation of the cycle air is disposed between the cold surface and the hot surface of the Peltier element.

In an embodiment of the present invention, fins are situated on the cold surface. Since the cycle air is passed over the cold surface after passing through the condenser, the number of fins to be used on the cold surface is decreased with respect to the prior art. By decreasing the number of fins on the cold surface, the pressure load on the fan is also decreased by reducing lowering of the pressure.

In all these embodiments, the cycle air passing over the cold surface of the Peltier element, by being turned 180°, is passed over the hot surface on the other side of the cold surface, which is disposed back to back with the cold surface.

By means of the present invention, the moisture retaining efficiency of the laundry dryer is increased by the cold surface of the Peltier element used in addition to the condenser. The drying air entirely cooled in two stages by passing through the condenser and over the cold surface of the Peltier element afterwards is passed over the hot surface of the Peltier element and the heater thereby completing the heating process also in two stages. By passing the cycle air first through the condenser before passing through the cold surface of the Peltier element provides the effectiveness of the Peltier element to be increased by the cycle air passing through the cold surface after reaching a value closer to the dew point. The drying air is first cooled and then heated by the energy provided to the Peltier element. This provides an advantage both in energy consumption and in terms of costs.

A laundry dryer realized in order to attain the aim of the present invention is illustrated in the attached figures, where:

FIG. 1—is the schematic view of a laundry dryer.

Figure 2:
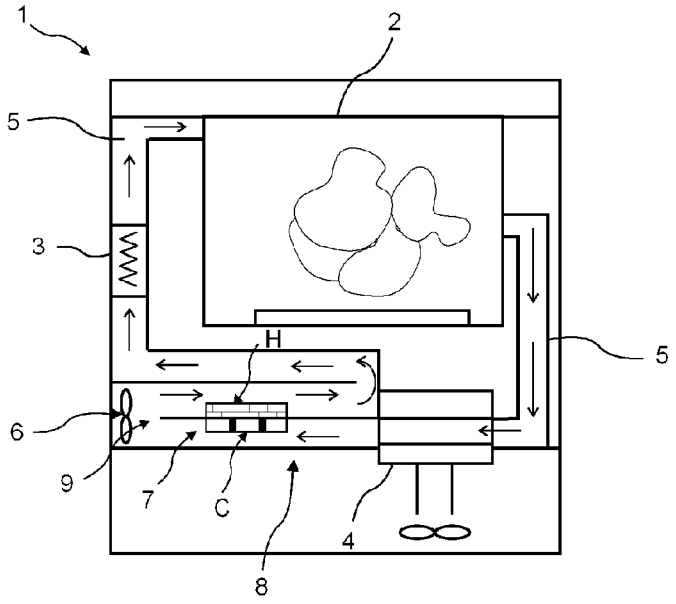

FIG. 2—is the schematic view of the laundry dryer in another embodiment of the present invention.

The elements illustrated in the figures are numbered as follows:

1. Laundry dryer
2. Drum
3. Heater
4. Condenser
5. Channel
6. Fan
7. Peltier element
8. Connection channel
9. Bend The laundry dryer (1) of the present invention comprises a drum (2) wherein the laundry desired to be dried is placed, a channel (5) with both ends connected to the drum (2), providing the cycle air to be circulated in a closed cycle, a condenser (4) providing the cycle air leaving the drum (2) to be dehumidified by being condensed, a heater (3) providing the dehumidified cycle air leaving the condenser (4) to be heated and at least one fan (6) maintaining the cycle air to move along the channel (5).

The laundry dryer (1) comprises a Peltier element (7) disposed between the condenser (4) and the heater (3), having a cold surface (C) where the cycle air leaving the condenser (4) passes over, and a hot surface (H) on the other side of the cold surface (C) located before the heater (3) over which the cycle air passing over the cold surface (C) passes before reaching the heater (3). The Peltier element (7) is formed by joining together the cold and hot surfaces (C and H) back to back (FIG. 1).

The cycle air is passed over the cold surface (C) of the Peltier element (7) after passing through the condenser (4). Thus, the effectiveness of the cold surface (C) is increased by providing the cycle air to pass through the cold surface (C) while at a value closer to the dew point, furthermore the performance of the Peltier element (7) is also increased since the temperature difference between the cold surface (C) and the hot surface (H) is low.

The air flow provided in the channel (5) by means of the fan (6) is a closed cycle and is referred to as the drying cycle. In the drying cycle, the cycle air leaves the drum (2) and by first passing over the condenser (4) in the channel (5), a large amount of the moisture contained therein is condensed by means of the condenser (4). Afterwards, the cycle air leaving the condenser (4) is also passed through the cold surface (C) of the Peltier element (7) thereby providing to condense herein the moisture that cannot be condensed in the condenser (4). Since the cycle air is first cooled by the condenser (4), it can reach the dew point more easily than reaching the cold surface (C) of the Peltier element (7). Thus, the cycle air, the moisture contained therein not being entirely retained by the condenser (4), is passed through the cold surface (C) of the Peltier element (7) whereby almost all of the remaining moisture not retained by the condenser (4) is provided to be retained by this cold surface (C). The cycle air, with a considerable amount of the moisture contained therein retained on the condenser (4) and the cold surface (C), is afterwards subjected to preheating by passing through the hot surface (H) of the Peltier element (7) and by also passing over the heater (3) is delivered through the channel (5) inlet into the drum (2) to be transferred onto the laundry. Thus, almost dry and hot air is delivered onto the laundry in the drum (2). Since a considerable amount of the moisture contained in the cycle air is retained by the condenser (4), the moisture that cannot be retained by the condenser (4) is provided to be retained by the cold surface (C) of the Peltier element (7) by consuming less energy. As a result of the cycle air reaching the cold surface (C) of the Peltier element (7) while at a value close to the dew point, the difference between the cold surface (C) temperature of the Peltier element (7) and the hot surface (H) temperature of the Peltier element (7) is decreased. This provides the performance (COP) value of the Peltier element (7) to be increased.

By means of the present invention, while the condensation process is performed in two stages by the cold surface (C) of the Peltier element (7) and the condenser (4), the heating process is also performed in two stages by using the hot surface (H) of the Peltier element (7) and the heater (3), thereby consuming less energy. Thus, the drying process is performed in a shorter period of time and by consuming less energy.

In an embodiment of the present invention, the laundry dryer (1) comprises a connection channel (8) connected between the condenser (4) and the heater (3), having a bend (9) that provides the cycle air leaving the condenser (4) to be turned 180° at least once to pass over the hot surface (H) after passing over the cold surface (C). The bend (9) is configured in a "U" or "C" shape. The connection channel (8) is in a horizontal position such that the cycle air is allowed to move in the horizontal direction.

In these embodiments, the cycle air passing over the cold surface (C) of the Peltier element (7) is provided to be passed over the hot surface (H), which is situated back to back with the cold surface (C), on the other side of the cold surface (C) by bending 180°. Thus, by using a single Peltier element (7), the cycle air is provided first to be cooled and then to be heated.

In another embodiment of the present invention, the fan (6) is disposed between the cold surface (C) and the hot surface (H) of the Peltier element (7) in the flow direction of the cycle air (FIG. 2).

In all the embodiments of the present invention, the laundry dryer (1) comprises fins that are located on the cold and hot surfaces (C and H) of the Peltier element (7) and that increase the heat transfer surface area by extending into the channel (5). Thus, the air leaving the condenser (4) moving in the channel (5) is provided to be cooled and/or heated more effectively. Since the cycle air is cooled by being passed through the condenser (4) before being passed over the cold surface (C), the moisture in the cycle air is retained effectively by using less fins with respect to the embodiments wherein a Peltier element is used prior to the condenser. By decreasing the number of fins, the pressure load acting particularly on the fan (6) is reduced.

By means of the present invention, the moisture retaining effectiveness or in other words the drying effectiveness of laundry dryers with condensers is increased. By using a Peltier element (7) in addition to the condenser (4) and the heater (3), both the condensation process and the heating process are performed in two stages. Thus, both moisture retaining and heating performances are improved and hence the laundry is provided to be dried in a shorter period of time by using less energy.

It is to be understood that the present invention is not limited to the embodiments disclosed above and a person skilled in the art can easily introduce different embodiments. These should be considered within the scope of the protection postulated by the claims of the present invention.

The invention claimed is:

1. A laundry dryer (1) comprising a drum (2) wherein the laundry desired to be dried is placed, a channel (5) with both ends connected to the drum (2), providing the cycle air to be circulated in a closed cycle, a condenser (4) providing the cycle air leaving the drum (2) to be dehumidified by being condensed, a heater (3) providing the dehumidified cycle air leaving the condenser (4) to be heated and at least one fan (6) maintaining the cycle air to move along the channel (5), and characterized by a Peltier element (7) disposed between the condenser (4) and the heater (3), having a cold surface (C) where the cycle air leaving the condenser (4) passes over, and a hot surface (H) on the other side of the cold surface (C) situated prior to the heater (3) over which the cycle air, passing through the cold surface (C), passes before reaching the heater (3).

2. The laundry dryer as in claim 1, further comprising a connection channel (8) that is fastened between the condenser (4) and the heater (3) and that has a bend (9) providing the cycle air which leaves the condenser (4) to be turned 180° at least once to pass over the hot surface (H) after passing over the cold surface (C).

3. The laundry dryer as in claim 2, wherein the bend (9) in the shape of a "U" or "C".

4. The laundry dryer as in claim 1 wherein the fan (6) that is disposed between the cold surface (C) and the hot surface (H) of the Peltier element (7) in the flow direction of the cycle air.

5. The laundry dryer as in claim 1 further comprising fins that are located on the cold and hot surfaces (C and H) of the Peltier element (7) and that increase the heat transfer surface area by extending into the channel (5).

6. The laundry dryer as in claim 2 wherein the fan (6) that is disposed between the cold surface (C) and the hot surface (H) of the Peltier element (7) in the flow direction of the cycle air.

7. The laundry dryer as in claim 3 wherein the fan (6) that is disposed between the cold surface (C) and the hot surface (H) of the Peltier element (7) in the flow direction of the cycle air.

8. The laundry dryer as in claim 2 further comprising fins that are located on the cold and hot surfaces (C and H) of the Peltier element (7) and that increase the heat transfer surface area by extending into the channel (5).

9. The laundry dryer as in claim 3 further comprising fins that are located on the cold and hot surfaces (C and H) of the Peltier element (7) and that increase the heat transfer surface area by extending into the channel (5).

10. The laundry dryer as in claim 4 further comprising fins that are located on the cold and hot surfaces (C and H) of the Peltier element (7) and that increase the heat transfer surface area by extending into the channel (5).

11. The laundry dryer as in claim 6 further comprising fins that are located on the cold and hot surfaces (C and H) of the Peltier element (7) and that increase the heat transfer surface area by extending into the channel (5).

12. The laundry dryer as in claim 7 further comprising fins that are located on the cold and hot surfaces (C and H) of the Peltier element (7) and that increase the heat transfer surface area by extending into the channel (5).

* * * * *